United States Patent [19]

Hunt

[11] 4,106,661

[45] Aug. 15, 1978

[54] INFLATABLY SEALED STERILIZER DOOR

[75] Inventor: Robert E. Hunt, Andover, Mass.

[73] Assignee: The United States of America as represented by the Secretary of the Army, Washington, D.C.

[21] Appl. No.: 774,166

[22] Filed: Mar. 3, 1977

Related U.S. Application Data

[63] Continuation of Ser. No. 647,238, Jan. 7, 1976, abandoned.

[51] Int. Cl.[2] ..... B65D 53/00; B65D 45/00

[52] U.S. Cl. ..... 220/232; 220/315; 220/344

[58] Field of Search ..... 220/232, 315, 324, 334, 220/344, 378, 316; 68/139; 233/1 A, 1 R

[56] References Cited

U.S. PATENT DOCUMENTS

| | | | |
|---|---|---|---|
| 658,588 | 9/1900 | Reynolds et al. | 220/232 |
| 2,559,564 | 7/1951 | Sperling | 200/232 |
| 2,818,992 | 1/1958 | Ekola | 220/232 |
| 2,942,753 | 6/1960 | Kelton | 220/378 X |
| 3,223,276 | 12/1965 | Gebhardt et al. | 220/232 |
| 3,458,083 | 7/1969 | Erwin, Jr. | 220/316 |

*Primary Examiner*—William Price
*Assistant Examiner*—Steven M. Pollard
*Attorney, Agent, or Firm*—William G. Gapcynski; Frank R. Agovino; Lawrence A. Neureither

[57] ABSTRACT

An apparatus for sealing a pressurized vessel comprising a hemispherical shaped door with an outer rigid surface, an insulating material, an inner rigid material with a flange affixed thereto, and a supporting member for use in combination with lock and hinge mechanisms, the flange on the door cooperating with an inflatable seal that is seated within a groove positioned on the inside surface of the mouth of the vessel.

1 Claim, 5 Drawing Figures

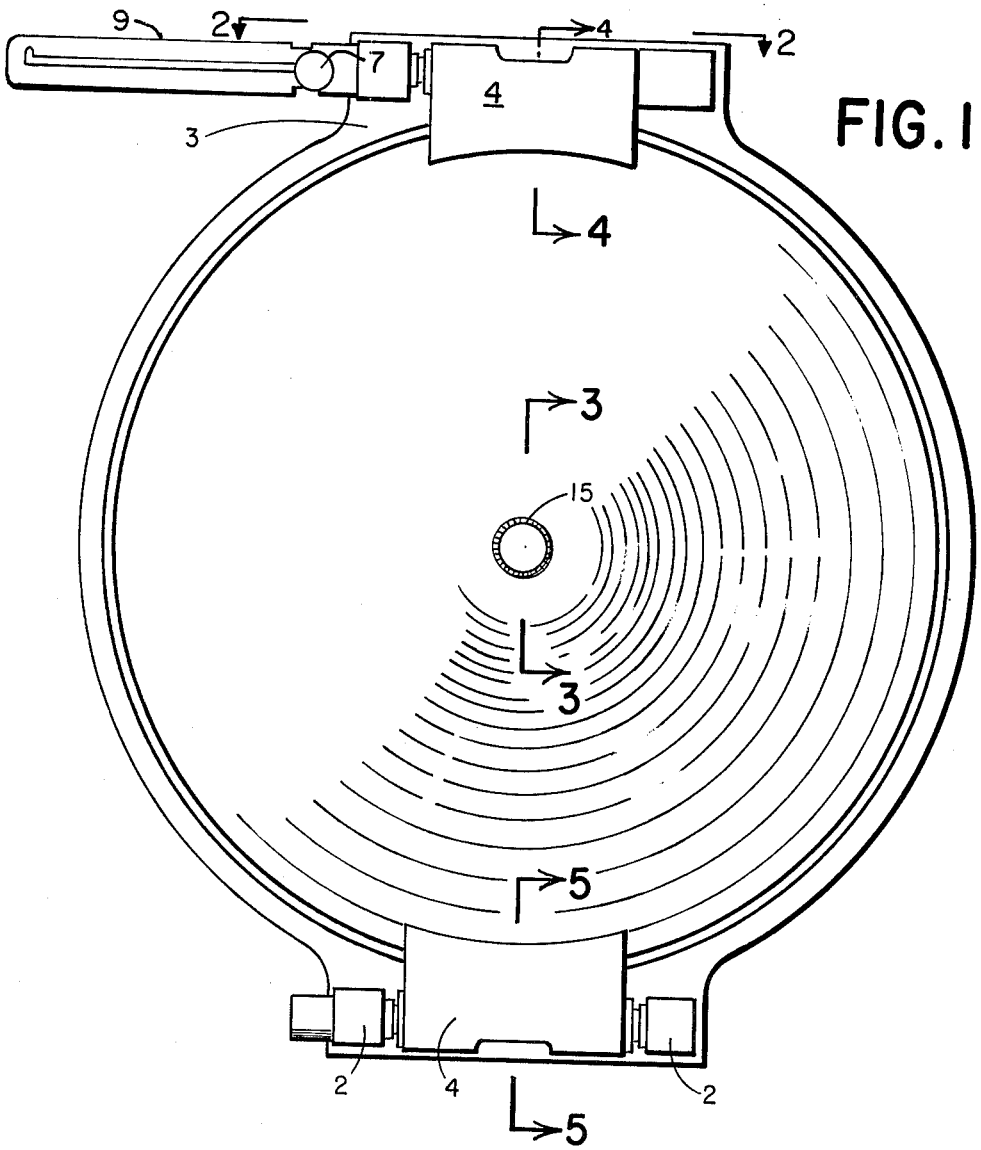
FIG. 1
FIG. 2
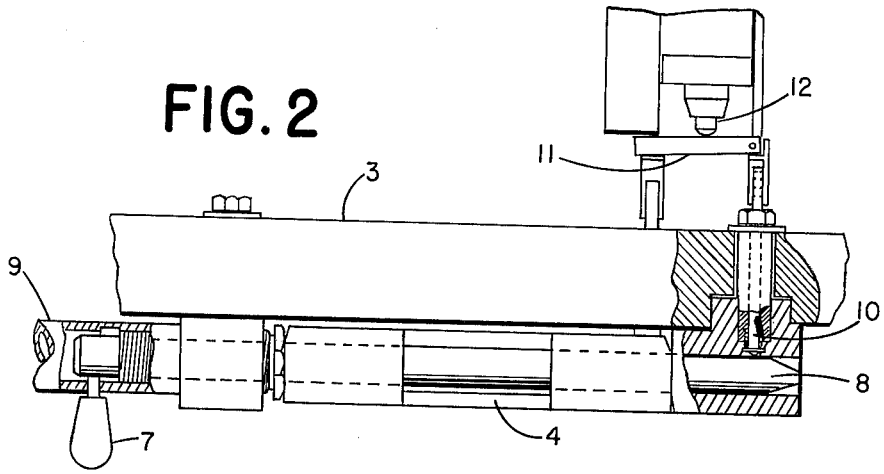

INFLATABLY SEALED STERILIZER DOOR

This is a continuation of application Ser. No. 647,238 filed Jan. 7, 1976, now abandoned.

BACKGROUND OF THE INVENTION

1. FIELD OF THE INVENTION

The invention is in the field of container covers. More particularly it concerns doors in combination with pressurized vessels utilizing an inflatable sealing means.

2. DESCRIPTION OF THE PRIOR ART

Static seals are traditionally carried and disposed between the container face and door. In a pressurized vessel, the strength of the locking mechanism and the shape and weight of the door determines air tightness of the static seal. In the development of the art to date, inflatable seals are arranged in the same fashion as the static seals they replaced. Therefore, the weight and shape limitations of the door remain.

Hemispherical doors have been used on pressurized vessels because of their ability to withstand greater pressure than flat ribbed doors of comparable size. The invention encompasses the cooperation between a flange on the inner surface of a hemispherical door and an inflatable seal. The invention incorporates a light weight transportable sterilizer designed for use by a field army. This invention adequately seals without requiring the massive dimensionally stable configurations used in the classical statically sealed sterilizer door.

SUMMARY OF THE INVENTION

The invention is in the structural sealing of hemispherical sterilizer doors with inflatable seals. The light weight hemispherical sterilizer door is comprised of an outer surface, insulating material, inner surface and flange. The flange is welded to the circumference of the inner surface, traversing the opening at the mouth at the container. The circumference of the flange is less than that of the mouth of the container, and is positioned over the inflatable seal when the door is in the closed position.

It, is therefore, an object of the present invention to provide an apparatus using an inflatable sealing device to form an air tight seal in a pressurized vessel.

Another object of the present invention is to provide an apparatus with an inflatable seal which will produce a force of friction between the inflatable seal and door in order to strengthen the force needed to overcome the pressure asserted against the inside of the door.

A further object of the present invention is to use a light weight door with a simple locking mechanism on a pressurized vessel.

BRIEF DESCRIPTION OF DRAWINGS

FIG. 1 is a full frontal view of the sterilizer door in the operating position;

FIG. 2 is a partially broken away top view of the locking mechanism as shown in the operating position taken along line 2—2 of FIG. 1;

DESCRIPTION OF THE PREFERRED EMBODIMENT

Figure 3:
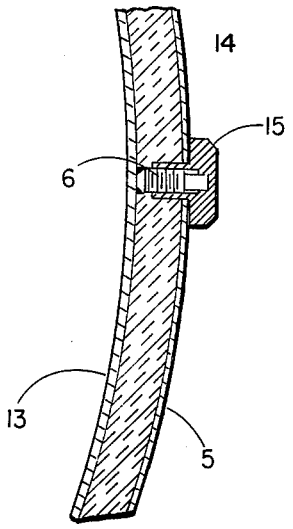
FIG. 3 is a partial cross sectional view of the sterilizer door taken along line 3—3 of FIG. 1.

The door is locked in place with a slot-pin latch generally shown as A which is attached to the body of the sterilizer vessel 3. A suitable hinge 2 allows the door to be opened away from the sterilizer vessel 3. Due to the desirability of having a light weight door, a single support 4 is welded to the door's inner surface 13 and used to fasten the door to the sterilizer vessel 3 and to cooperate with the locking function of the slot-pin latch shown at A. The outer door surface 5 and the insulating material 14, shown in FIG. 3, are held in place with a securing nut 15.

The handle 7 operates the sliding bolt 8 within the slot pin bracket 9 which is attached to the sterilizer vessel 3. In the operating position, the sliding bolt makes contact with and depresses the safety pin 10, which mechanically depresses the bar lever 11, forcing the circuit breaker button 12 into a contact operative mode.

The sterilizer door is comprised of an inner door surface 13 with the attached securing stud 6, insulating material 14 and outer door surface 5. The insulating material 14 and the outer door surface 5 are held firmly against the inner door surface 13 with the securing nut 15. The inner door durface 13 is made of a material which has a smooth, non-corrosive surface. The insulating material 14 is chosen for its light weight and inability to conduct heat. The outer door surface 5 is made of any light weight noncorrosive material suitable for covering the insulating material 14 in light of the projected use of the apparatus.

Figure 4:
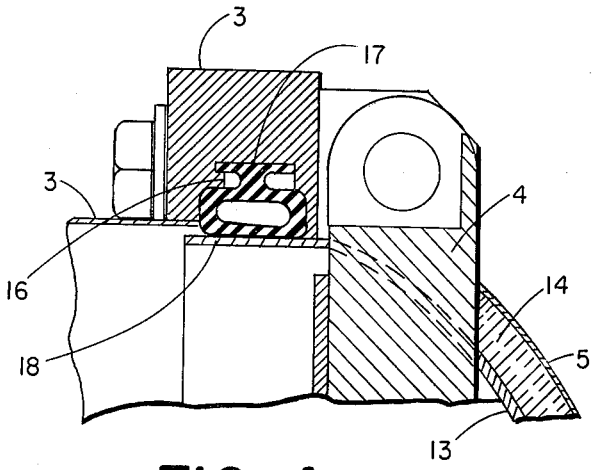
FIG. 4 is an enlarged cross section view of the top of the door in the closed position with the seal inflated and contacting the flange taken along line 4—4 of FIG. 1.
Figure 5:
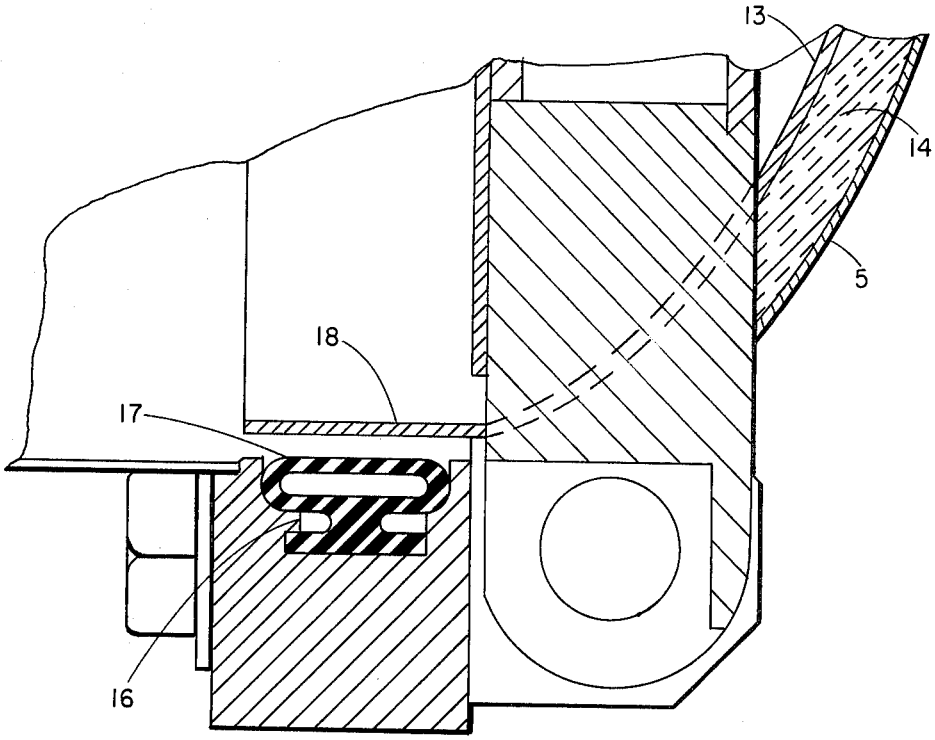
FIG. 5 is the enlarged cross section of the bottom of the sterilizer door with the seal deflated and showing the flange positioned above the inflatable seal and seal groove taken along line 5—5 of FIG. 1.

As shown in FIG. 4, a part of and therein forming the mouth of the sterilizer vessel 3 is the inflatable seal groove 16 providing a seat for the inflatable seal 17 which contacts the door's flange 18. In its noninflated state as shown in FIG. 5 the seal 17 does not make contact with the flange 18. The flange 18 is welded to the inner door surface 13 and is of a size which will pass through the vessel opening, be sufficiently long to cover the entire top surface of the inflatable seal 17 and be of a height over seal 17 which will facilitate the greatest percentage of contract area with the seal 17. The flange 18 is made of a material which has a smooth and noncorrosive surface where contact will be made with the inflatable seal 17, however, the smoothness is not so critical as when using a conventional static seal. The inflatable seal 17 is made of nitrited rubber, and is inflated with steam or water from the boiler feed pumps or any other media by adding a free piston isolation unit. Any of the desired means is connected in the conventional manner. When the sterilizer is in operation the inflatable seal 17 will contact the flange 18 and provide an air tight seal as shown in FIG. 4. Although a particular embodiment and form of this invention has been illustrated, it is obvious to those skilled in the art that modifications may be made without departing from the scope and spirit of the foregoing disclosure.

I claim:

1. An apparatus for sealing a container comprising:

a. locking means having a track guide connected to the container, a bolt having tapered and untapered ends located in said track guide, a handle connected to the untapered end of said bolt, said track guide slotted for communication therethrough of said handle, and a receiving chamber connected to said container for receiving the tapered end of said bolt when said bolt is in the closed condition;

b. interlock means connected to said receiving chamber having a bar lever with first and second ends, said interlock means having a pin having one end located in and perpendicular to said receiving chamber and the other end connected to the first end of said bar lever, the second end of said bar lever hingedly affixed to said container and a circuit breaker button connected to the center of said bar lever;

c. a cover disposed over the mouth of the container, said cover having an inner rigid surface, a supportive member attached to said inner rigid surface having a hole therein positioned for communication with said bolt when said cover is in the closed condition, an outer rigid surface located parallel to said inner surface and removably affixed thereto, and insulating material located between said inner and outer materials;

d. a rigid flange affixed to the inside of said cover and positioned parallel and adjacent to the inner surface of the mouth of the container;

e. an inflatable seal carried in a recess in the inner surface of the mouth of the container, said inflatable seal when inflated making airtight contact with said flange and the inner surface of the mouth of the container causing a force in a direction perpendicular to said flange and the inside of the container; and f. a hinge connecting said cover to said container whereby a frictional force is created which prevents the opening of said cover.

* * * * *